US010024335B2

(12) United States Patent
Sezal et al.

(10) Patent No.: US 10,024,335 B2
(45) Date of Patent: Jul. 17, 2018

(54) APPARATUS FOR TRANSFERRING ENERGY BETWEEN A ROTATING ELEMENT AND FLUID

(71) Applicant: General Electric Company, Schenectady, NY (US)

(72) Inventors: Ismail Hakki Sezal, Munich (DE); Christian Aalburg, Munich (DE); Rajesh Kumar Venkata Gadamsetty, Bangalore (IN); Matthias Carl Lang, Munich (DE); Venkata Rama Krishna Chaitanya Ongole, Bangalore (IN); Alberto Scotti del Greco, Figline Valdarno (IT)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 792 days.

(21) Appl. No.: 14/315,382

(22) Filed: Jun. 26, 2014

(65) Prior Publication Data

US 2015/0377251 A1 Dec. 31, 2015

(51) Int. Cl.
*F04D 29/44* (2006.01)
*F04D 29/46* (2006.01)
(Continued)

(52) U.S. Cl.
CPC ..... *F04D 29/444* (2013.01); *F01D 9/048* (2013.01); *F04D 17/10* (2013.01); *F04D 17/122* (2013.01);
(Continued)

(58) Field of Classification Search
CPC .... F04D 29/444; F04D 29/442; F04D 29/462; F04D 29/4213; F01D 17/122; F01D 17/10; F05D 2250/51; F05D 2250/72
See application file for complete search history.

(56) References Cited

U.S. PATENT DOCUMENTS 3,536,414 A 10/1970 Smith
5,313,779 A 5/1994 Rodgers
(Continued)

FOREIGN PATENT DOCUMENTS

CN 102128179 A 7/2011
JP 0893691 A 4/1996
(Continued)

OTHER PUBLICATIONS

Machine Translation of JPH0893691 [retrieved on Jun. 5, 2017]. Retrieved from: Espacenet.*
(Continued)

*Primary Examiner* — Igor Kershteyn
*Assistant Examiner* — Eric Zamora Alvarez
(74) *Attorney, Agent, or Firm* — GE Global Patent Operation; Pabitra Chakrabarti

(57) ABSTRACT

In some embodiments, a plenum of an apparatus for transferring energy between a rotating element and a fluid may include a through hole disposed through the plenum; a plurality of inlet guide vanes disposed proximate a peripheral edge of the through hole, the plurality of inlet guide vanes comprising a first group of inlet guide vanes having a symmetrical profile, a second group of inlet guide vanes, and a third group of inlet guide vanes, wherein each inlet guide vane of the second group and third group have a cambered profile, and wherein each inlet guide vane of the third group has a different cambered profile from each other inlet guide vane of the third group.

22 Claims, 4 Drawing Sheets

(51) Int. Cl.

| | |
|---|---|
| ***F04D 29/42*** | (2006.01) |
| ***F04D 17/10*** | (2006.01) |
| ***F01D 9/04*** | (2006.01) |
| ***F04D 17/12*** | (2006.01) |

(52) U.S. Cl.
CPC ..... *F04D 29/4213* (2013.01); *F04D 29/442* (2013.01); *F04D 29/462* (2013.01); *F05D 2250/51* (2013.01); *F05D 2250/72* (2013.01)

(56) References Cited

U.S. PATENT DOCUMENTS

| | | | | |
|---|---|---|---|---|
| 5,851,103 | A | 12/1998 | Harada et al. | |
| 6,709,232 | B1 | 3/2004 | Vogiatzis | |
| 7,520,716 | B2 | 4/2009 | Tacconelli et al. | |
| 7,824,148 | B2 | 11/2010 | Tetu et al. | |
| 8,079,808 | B2 | 12/2011 | Sconfietti | |
| 8,326,513 | B2 | 12/2012 | Singh et al. | |
| 8,596,955 | B2 | 12/2013 | Freeman et al. | |
| 2009/0208331 | A1 | 8/2009 | Haley et al. | |
| 2011/0176913 | A1 | 7/2011 | Wassynger et al. | |
| 2012/0263586 | A1 | 10/2012 | Patil | |
| 2012/0294711 | A1* | 11/2012 | Grigoriev | F04D 29/444 415/204 |
| 2013/0224004 | A1 | 8/2013 | Radhakrishnan et al. | |
| 2013/0315718 | A1* | 11/2013 | Parker | F02B 37/22 415/157 |

FOREIGN PATENT DOCUMENTS

| | | | |
|---|---|---|---|
| JP | H0893691 | * | 9/1996 |
| SU | 1211419 | A1 | 2/1986 |
| WO | 2013128539 | A1 | 9/2013 |

OTHER PUBLICATIONS

Mohseni et al., "Novel IGV Designs for Centrifugal Compressors and Their Interaction With the Impeller", Journal of Turbomachinery, Mar. 2012, vol. 134, Issue 2, 8 pages.

Mohtar et al., "Variable Inlet Guide Vanes in a Turbocharger Centrifugal Compressor: Local and Global Study", Laboratory of Fluid Mechanics, Ecole Centrale de Nantes, Apr. 14, 2008, pp. 1-13.

L.G. Tetu, "Improving Centrifugal Compressor Performance by Optimizing Diffuser Surge Control (Variable Diffuser Geometry) and Flow Control (Inlet Guide Vane) Device Settings", International Compressor Engineering Conference at Purdue, Carrier Corporation, Jul. 12-15, 2004, pp. 1-9.

PCT Search Report and Written Opinion issued in connection with corresponding PCT Application No. PCT/US2015/033484 dated Sep. 10, 2015.

Machine translation and Office Action issued in connection with Corresponding CN Application No. 201580034273.0 dated Jul. 20. 2017.

* cited by examiner

APPARATUS FOR TRANSFERRING ENERGY BETWEEN A ROTATING ELEMENT AND FLUID

BACKGROUND

The subject matter disclosed herein generally relates to apparatus for transferring energy between a rotating element and fluid, and more specifically to turbomachinery, for example, centrifugal compressors.

Conventional turbomachinery, for example centrifugal compressors, generally include a plenum configured to direct a working gas (e.g., air, natural gases, hydrocarbons, carbon dioxide, or the like) from an inlet to one or more impellers to facilitate transferring energy from the impellers to the working gas. To direct the flow of the working gas through the plenum and towards the impellers in a desired flow path, a number of inlet guide vanes are disposed symmetrically within the plenum. In some variations, to correct an inlet swirl to the compressor caused by a variation in mass flow each of the inlet guide vanes may be rotated about its axis, thereby improving operation. However, the inventors have observed that such configurations of the inlet guide vanes introduce losses into the plenum, thereby negatively affecting compressor performance and reducing efficiency of the compressor.

Therefore, the inventors have provided an improved apparatus for transferring energy between a rotating element and fluid.

SUMMARY

Embodiments of an apparatus for transferring energy between a rotating element and a fluid are provided herein.

In some embodiments, a plenum of an apparatus for transferring energy between a rotating element and a fluid may include a through hole disposed through the plenum; a plurality of inlet guide vanes disposed proximate a peripheral edge of the through hole, the plurality of inlet guide vanes comprising a first group of inlet guide vanes having a symmetrical profile, a second group of inlet guide vanes, and a third group of inlet guide vanes, wherein each inlet guide vane of the second group and third group have a cambered profile, and wherein each inlet guide vane of the third group has a different cambered profile from each other inlet guide vane of the third group.

In some embodiments, an apparatus for transferring energy between a rotating element and a fluid may include an housing having an inlet to allow a flow of fluid into the housing; a plenum defining a flow path fluidly coupled to the inlet, the plenum having a through hole disposed through the plenum; a plurality of inlet guide vanes disposed proximate a peripheral edge of the through hole, the plurality of inlet guide vanes comprising a first group of inlet guide vanes having a symmetrical profile, a second group of inlet guide vanes, and a third group of inlet guide vanes, wherein each inlet guide vane of the second group and third group have a cambered profile, and wherein each inlet guide vane of the third group has a different cambered profile from each other inlet guide vane of the third group.

The foregoing and other features of embodiments of the present invention will be further understood with reference to the drawings and detailed description.

DESCRIPTION OF THE FIGURES

Embodiments of the present invention, briefly summarized above and discussed in greater detail below, can be understood by reference to the illustrative embodiments of the invention depicted in the appended drawings. It is to be noted, however, that the appended drawings illustrate only typical embodiments of the invention and are therefore not to be considered limiting in scope, for the invention may admit to other equally effective embodiments.

To facilitate understanding, identical reference numbers have been used, where possible, to designate identical elements that are common to the figures. The figures are not drawn to scale and may be simplified for clarity. It is contemplated that elements and features of one embodiment may be beneficially incorporated in other embodiments without further recitation.

DETAILED DESCRIPTION

Embodiments of an apparatus for transferring energy between a rotating element and a fluid are provided herein. The inventive apparatus advantageously provides a plenum having a plurality of inlet guide vanes configured to reduce or eliminate losses in the plenum that would otherwise be caused by conventionally configured inlet guide vanes, thereby increasing the efficiency of the apparatus. While not intending to be limiting, the inventors have observed that the inventive apparatus may be particularly advantageous in applications including compressors, for example, such as centrifugal compressors.

Figure 1:
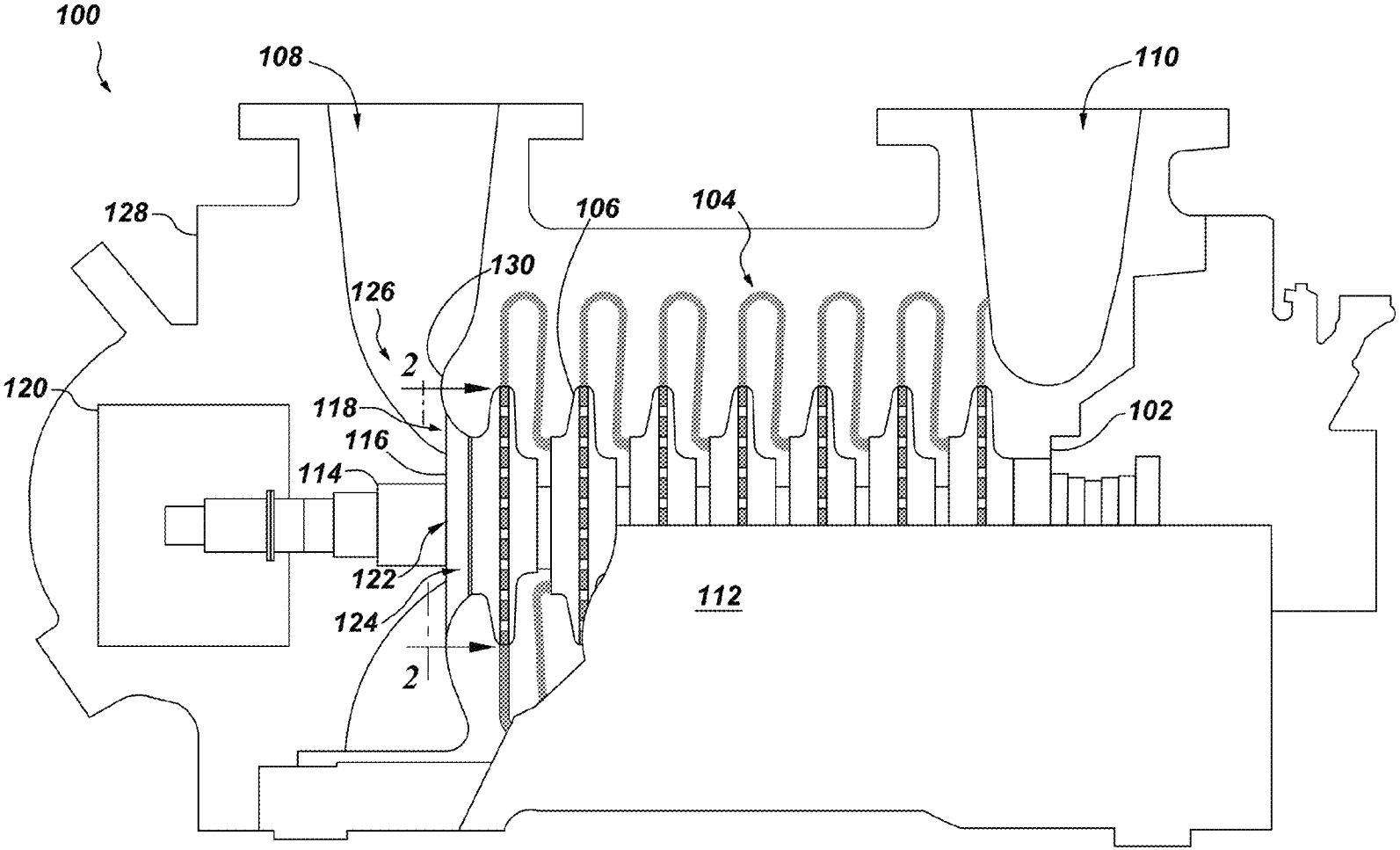
FIG. 1 is a partial cross sectional view of a portion of an exemplary apparatus for transferring energy between a rotating element and a fluid in accordance with some embodiments of the present invention.

FIG. 1 is a partial cross sectional view of a portion of an exemplary apparatus 100 for transferring energy between a rotating element and a fluid in accordance with some embodiments of the present invention. The apparatus 100 may be any apparatus suitable to facilitate a transfer of energy between a rotating element and a fluid, for example, a turbomachine such as a centrifugal compressor, or the like.

The apparatus (compressor) 100 generally comprises a body 128 defining an inner cavity 102, a plurality of flow paths 104, and an inlet 108 and outlet 110, wherein the inlet 108 and outlet 110 are fluidly coupled to the plurality of flow paths 104. A rotatable shaft 114 having a plurality of impellers 106 coupled thereto is disposed at least partially within the inner cavity 102. In some embodiments a housing (partially shown) 112 may be disposed about the body 128.

In some embodiments, the rotatable shaft 114 may be rotated within the inner cavity 102 via a motor 120. The motor 120 may be any type of motor suitable to rotate the rotatable shaft 114 at a desired speed, for example, an electric motor, hydraulic motor, combustion engine, or the like.

In some embodiments, a working gas (e.g., air, natural gases, hydrocarbons, carbon dioxide, or the like) is directed towards the impellers 106 via a plenum 118. The plenum 118 generally comprises an inlet 126 fluidly coupled to the inlet 108 of the body 128, a through hole 124 fluidly coupled to the inlet 126 and a curved inner surface 130 configured to direct the working gas from the inlet 126 towards the through hole 124. In some embodiments, the plenum 118 may be at least partially formed by the body 128, for example, such as shown in FIG. 1. In some embodiments, a ring 116 having a through hole 122 that is concentric to the through hole 124 of plenum 118 may be disposed within the plenum 118 to further facilitate the flow of the working gas from inlet 108 to the impellers 106 in a desired flow path.

In an exemplary operation of the compressor 100, the shaft 114 and impellers 106 may be rotated within the inner cavity 102 via the motor 120. The working gas is drawn into the inlet 108 of the body 128 via a suction force caused by the rotation of the impellers 106 and is directed to the impellers 106 via the plenum 118. The working gas is pressurized via a flow of the working gas through the impellers 106 and flow paths 104 and then discharged from the body 128 via the outlet 110.

The inventors have observed that conventional compressors typically include a number of symmetrical inlet guide vanes disposed within a plenum (e.g., the plenum 118 described above) to direct the flow of the working gas through the plenum and towards a plurality of impellers (e.g., the impellers 106 described above) in a desired flow path. In some variations, to correct an inlet swirl to the compressor caused by a variation in mass flow, each of the inlet guide vanes may be rotated about a central axis of the inlet guide vane, thereby potentially improving operation. However, the inventors have observed that such configurations of the inlet guide vanes introduce losses into the plenum, thereby negatively affecting compressor performance and reducing efficiency of the compressor.

Figure 2:
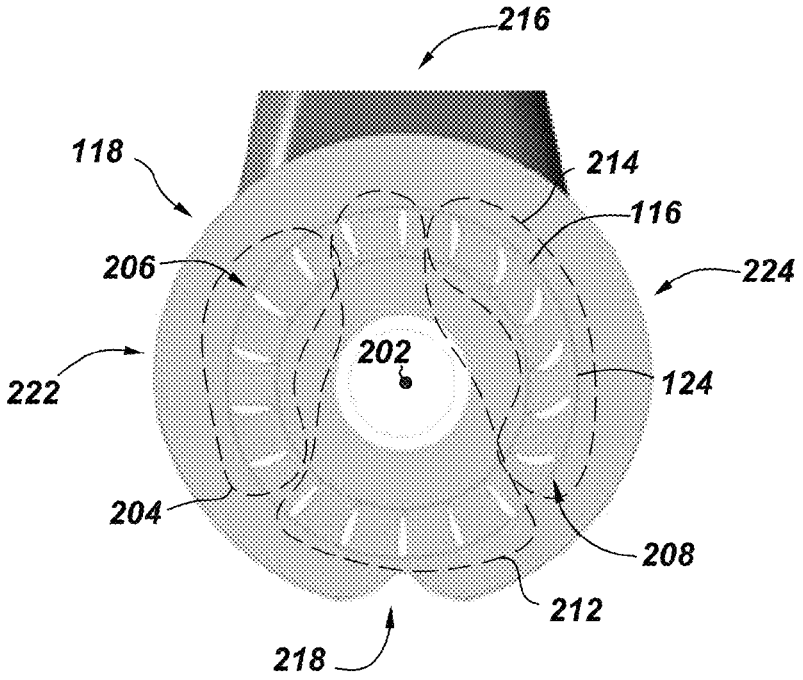
FIG. 2 depicts a portion of the apparatus of FIG. 1 with respect to the line 2-2 of FIG. 1 in accordance with some embodiments of the present invention.

As such, referring to FIG. 2, in some embodiments, the plenum 118 comprises a plurality of inlet guide vanes 206 disposed proximate a peripheral edge 208 of the through hole 124. The plurality of inlet guide vanes 206 generally comprises a first group 212 of inlet guide vanes, a second group 204 of inlet guide vanes, and a third group 214 of inlet guide vanes. In some embodiments, each inlet guide vane of the first group 212 has a symmetric profile (e.g., such as described below with respect to FIG. 5) and each inlet guide vane of the second group 204 and the third group 214 have a cambered profile (e.g., such as described below with respect to FIG. 7). In such embodiments, each inlet guide vane of the second group 204 has the same cambered profile and each inlet guide vane of the third group 214 has a profile that differs from each other inlet guide vane within the third group 214. In addition, in some embodiments each inlet guide vane of the third group 214 may have a different length (e.g., such as described below with respect to FIG. 7). The inventors have observed that by providing the first group 212, second group 204, third group 214 of inlet guide vanes as described herein, losses in the plenum 118 that would otherwise be caused by conventionally configured inlet guide vanes may be reduced or eliminated, thereby increasing the efficiency of the compressor.

The plurality of inlet guide vanes 206 may be disposed about the plenum 118 with respect to one another and with respect to the peripheral edge 208 of the through hole 124 in any manner suitable to maximize flow of the working gas and reduce losses in the plenum. In some embodiments, the placement and orientation of the plurality of inlet guide vanes 206 may be dependent on an angle of the flow of the working gas entering the plenum 118 at various positions about the plenum 118. For example, in some embodiments, each of the plurality of inlet guide vanes 206 may be disposed substantially equidistant from one another about the plenum 118, such as shown in FIG. 2. In another example, in some embodiments, each of the plurality of inlet guide vanes 206 may be disposed on the ring 116, also as shown in FIG. 2.

The first group 212 of inlet guide vanes may be disposed about the plenum 118 in any position suitable to maximize flow of the working gas and reduce losses in the plenum 118, thereby increasing compressor efficiency. For example, in some embodiments, one or more inlet guide vanes of the first group 212 of inlet guide vanes may be disposed proximate a top 216 of the plenum 118 and one or more inlet guide vanes of the first group 212 of inlet guide vanes may be disposed proximate a bottom 218 of the plenum 118, opposite the top 216 of the plenum 118. In another example, in some embodiments, two inlet guide vanes of first group 212 of inlet guide vanes may be disposed proximate the top 216 of the plenum 118 and five inlet guide vanes of the first group 212 of inlet guide vanes may be disposed proximate the bottom 218 of the plenum 118, such as shown in FIG. 2.

Figure 3:
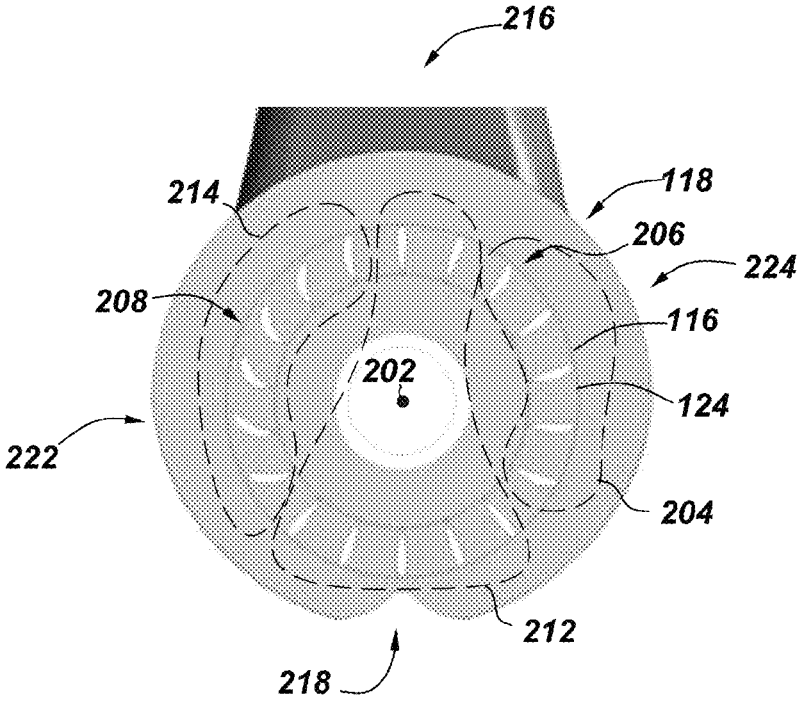
FIG. 3 depicts a portion of the apparatus of FIG. 1 with respect to the line 2-2 of FIG. 1 in accordance with some embodiments of the present invention.

The second group 204 of inlet guide vanes may be disposed about the plenum 118 in any position suitable to maximize flow of the working gas and reduce losses in the plenum. For example, in some embodiments, one or more inlet guide vanes of the second group 204 of inlet guide vanes may be disposed proximate a first side 222 of the plenum 118, such as shown in FIG. 2. Alternatively, in some embodiments, the second group 204 of inlet guide vanes may be disposed proximate a second side 224, opposite the first side 222, of the plenum 118, such as shown in FIG. 3.

The third group 214 of inlet guide vanes may be disposed about the plenum 118 in any position suitable to maximize flow of the working gas and reduce losses in the plenum 118. For example, in some embodiments, one or more inlet guide vanes of the third group 214 of inlet guide vanes may be disposed proximate the second side 224 of the plenum 118, such as shown in FIG. 2. Alternatively, in some embodiments, the third group 214 of inlet guide vanes may be disposed proximate the first side 222, of the plenum 118, such as shown in FIG. 3.

The inventors have observed that the selective placement of the first group 212, second group 204, third groups 214 of the plurality of inlet guide vanes 206 as described above may be utilized to accommodate for an angle of flow of the working gas with respect to the plenum 118, thereby maximizing flow of the working gas and reduce losses in the plenum 118. In addition, the placement of each of the first 212, second 204, third groups 214 may dictate the profile or camber of each of the plurality of inlet guide vanes 206.

For example, the first group 212 of inlet guide vanes disposed at the top 216 and bottom 218 of the plenum 118 may have a symmetrical profile to accommodate for a lessened effect of the incoming flow of working gas due to the direction of the flow at the top 216 and bottom 218 of the plenum 118. The second group 204 of inlet guide vanes (e.g., the first side 222 of the plenum 118, as shown in FIG. 2 or the second side 224 of the plenum 118, as shown in FIG. 3)

may have a weak cambered profile (as described below with respect to FIG. 7), or comparatively weaker cambered profile as compared to the third group 214 to accommodate for a low angle of flow of the working gas with respect to the plenum 118. The third group 214 of inlet guide vanes (e.g., the first side 222 of the plenum 118, as shown in FIG. 3 or the second side 224 of the plenum 118, as shown in FIG. 2) may have a strong cambered profile (as described below with respect to FIG. 7), or comparatively stronger cambered profile as compared to the third group 214, to accommodate for a low angle of flow of the working gas with respect to the plenum 118.

Figure 4:
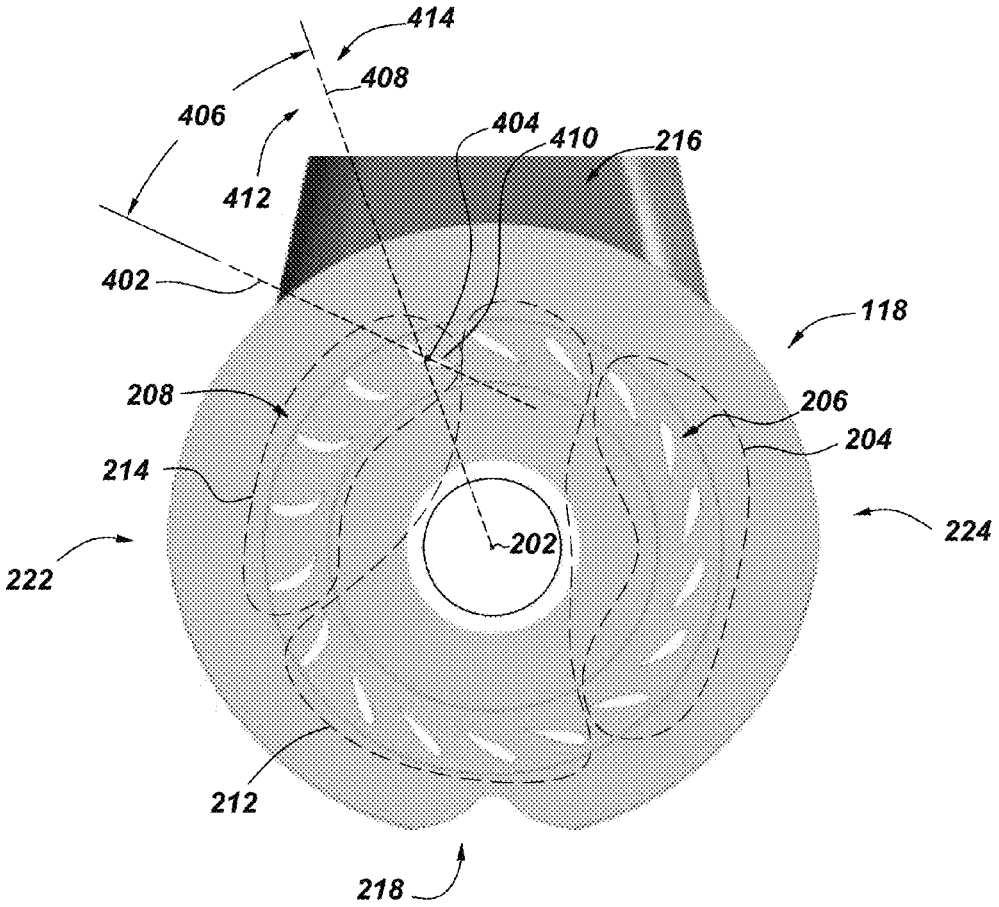
FIG. 4 depicts a portion of the apparatus of FIG. 1 with respect to the line 2-2 of FIG. 1 in accordance with some embodiments of the present invention.

Referring to FIG. 4, the plurality of inlet guide vanes 206 may be oriented with respect to the central axis 202 of the plenum 118 in any orientation. In addition, in some embodiments, each of the plurality of inlet guide vanes 206 may be rotatable about a rotation axis (pivot point) (rotation axis 404 of a single inlet guide vane 410 shown in the figure). Although only one rotation axis 404 is shown, it is to be understood that each inlet guide vane of the plurality of inlet guide vanes 206 has a rotation axis as described herein. The plurality of inlet guide vanes 206 may be rotated via any mechanism suitable to rotate the plurality of inlet guide vanes 206 with a desired degree of accuracy, for example, such as a common actuator ring or the like.

The rotation axis 404 may be disposed at any location across the inlet guide vane 410 suitable to provide a desired rotation of the inlet guide vane 410. For example in some embodiments, the rotation axis 404 may be disposed on or proximate a chord line 402 of the inlet guide vane 410, and further, on or proximate a geometric center of the inlet guide vane 410. In some embodiments, the rotation axis 404 of every inlet guide vane of the plurality of inlet guide vanes 404 may be disposed at a same radius with respect to the plenum 118 to facilitate movement of the plurality of inlet guide vanes 404 via a common mechanism.

The plurality of inlet guide vanes 404 may be rotated at any rotation angle 406 suitable to accommodate variations in mass flow, thereby facilitating efficient operation of the plenum 118 and thus, increasing the efficiency of the compressor. As defined herein, the angle of rotation 406 may be defined by an angle between the chord line 402 of the inlet guide vane 410 and an axis 408 of the plenum 118 connecting the center 202 of the plenum 118 to the rotation axis 404 of the inlet guide vane 410.

For example, the angle of rotation 406 may be about −30 degrees to about 70 degrees. As used herein, a negative angle indicates the rotation of the inlet guide vane 410 away from a first side 412 of the axis 408 (e.g., as shown in the figure) and a positive angle indicates rotation away from a second side 414 of the axis 408. In any of the embodiments described above, all of the inlet guide vanes of the second group 204 may be simultaneously rotated at the same angle of rotation 406, or alternatively may have varying angles of rotation 406.

Figure 5:
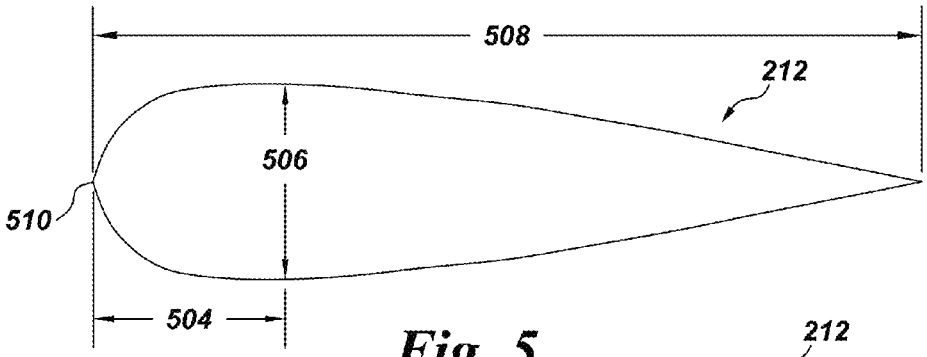
FIG. 5 is a side view of an inlet guide vane suitable for use with the apparatus of FIG. 1 in accordance with some embodiments of the present invention.
Figure 6:
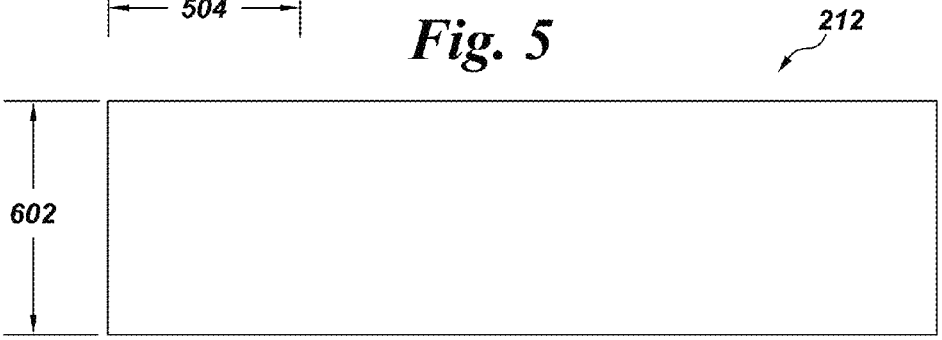
FIG. 6 is a top view of an inlet guide vane suitable for use with the apparatus of FIG. 1 in accordance with some embodiments of the present invention.

Referring to FIG. 5, the first group 212 of inlet guide vanes may have any dimensions suitable to maximize flow of the working gas and reduce losses in the plenum, while retaining a symmetrical profile. In some embodiments, the dimensions may be dictated by the size and shape of the plenum. For example, in some embodiments, each of the inlet guide vanes of first group 212 may have a length 508 and width (span) 602 (shown in FIG. 6) suitable to allow the inlet guide vanes to rotate without extending beyond an outer edge of the plenum ring (e.g., ring 116 described above). In some embodiments, the first group 212 of inlet guide vanes may have a maximum thickness 506 that is about 19% to about 25% of the length 508, wherein the maximum thickness 506 is located a distance 504 from the leading edge 510 of about 30% of the length 508.

Figure 7:
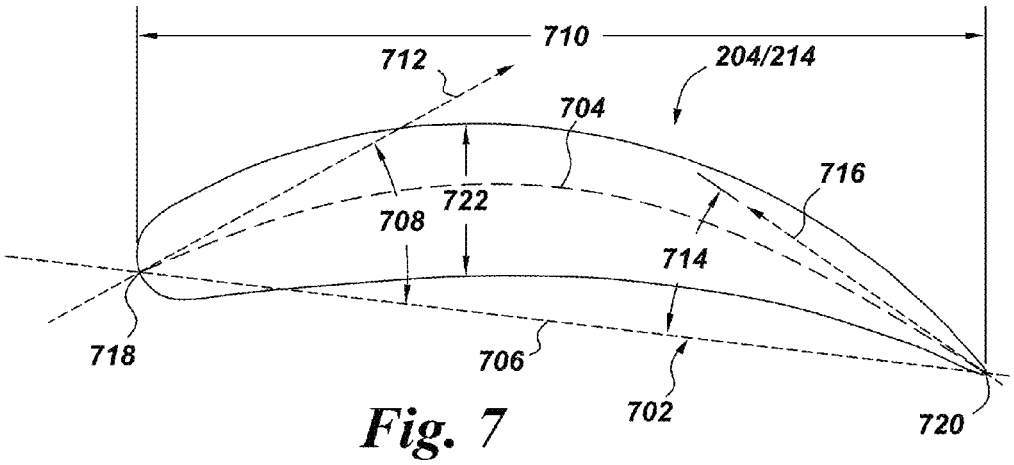
FIG. 7 is a side view of an inlet guide vane suitable for use with the apparatus of FIG. 1 in accordance with some embodiments of the present invention.

Referring to FIG. 7, the second group 204 of inlet guide vanes and third group 214 of inlet guide vanes, may have any dimensions suitable to maximize flow of the working gas and reduce losses in the plenum. In some embodiments, the dimensions of the second group 204 and third group 214 may be dictated by an angle of incoming flow of the working gas and/or the placement of the inlet guide vane with respect to the plenum. For example, in some embodiments, a leading edge angle 708 (an angle between a tangential component 712 of the camber mean line 704 and the chord line 706) and/or the trailing edge angle 714 (an angle between a tangential component 716 of the camber mean line 704 and the chord line 706) of the inlet guide vane may be substantially similar to incoming flow angle. In such embodiments, the leading edge angle 708 may be about 20 to about 80 degrees and the trailing edge angle 714 may be about 0 to about −15 degrees.

Figure 8:
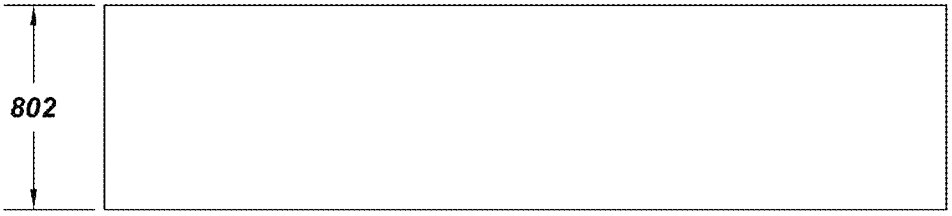
FIG. 8 is a top view of an inlet guide vane suitable for use with the apparatus of FIG. 1 in accordance with some embodiments of the present invention.

In some embodiments, a length 710 and width 802 (shown in FIG. 8) of each inlet guide vane of second group 204 and third group 214 of inlet guide vanes may be of any magnitude suitable to allow the inlet guide vanes to rotate without extending beyond an outer edge of the plenum ring (e.g., ring 116 described above). In such embodiments, the length 710 of each inlet guide vane may be varied in accordance with leading edge angle 708 and trailing edge angle 714 (e.g., in the third group 214 where each inlet guide vane has a different profile). In some embodiments, a thickness 722 of the inlet guide vane may vary along the length 710 of the inlet guide vane. For example the thickness may increase from the leading edge 718 to a maximum at about 30 to about 40% of a length of the chord line 706, then decrease as it approaches the trailing edge 720.

In addition, the second group 204 of inlet guide vanes and third group 214 of inlet guide vanes may have a positive or negative camber (negative camber shown at 702). As defined herein, an inlet guide vane having a negative camber with a higher magnitude (increased curve) is considered to have a "stronger" camber as compared to an inlet guide vane having a negative having a lower magnitude (e.g., a "weaker" camber). The camber may be any type of camber known in the art, for example, a linear camber, s-camber, a combination thereof, or the like.

Thus, embodiments of an apparatus for transferring energy between a rotating element and a fluid have been provided herein. In at least one embodiment, the inventive apparatus advantageously reduces or eliminates losses in a plenum of the apparatus that would otherwise be caused by conventionally configured inlet guide vanes, thereby increasing the efficiency of the apparatus.

Ranges disclosed herein are inclusive and combinable (e.g., ranges of "about 0 to about −15 degrees", is inclusive of the endpoints and all intermediate values of the ranges of "about 0 to about −15 degrees," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "some embodiments", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A plenum for use in an apparatus for transferring energy between a rotating element and a fluid, the plenum comprising:

a through hole disposed through the plenum;

a plurality of inlet guide vanes disposed proximate a peripheral edge of the through hole, the plurality of inlet guide vanes comprising a first group of inlet guide vanes having a symmetrical profile, a second group of inlet guide vanes and a third group of inlet guide vanes, wherein the second group is separated from the third group by one or more inlet guide vanes of the first group; and wherein each inlet guide vane of the second group and third group have a cambered profile, and wherein each inlet guide vane of the third group has a different cambered profile from each other inlet guide vane of the third group;

further comprising a ring disposed at least partially within the through hole, wherein the plurality of inlet guide vanes are coupled to the ring;

wherein each of the plurality of inlet guide vanes are rotatably coupled to the ring, and wherein each of the plurality of inlet guide vanes rotate about an axis of rotation of each of the plurality of inlet guide vanes.

2. The plenum of claim 1, wherein the plurality of inlet guide vanes are disposed symmetrically about the peripheral edge of the through hole.

3. The plenum of claim 1, wherein the first group of inlet guide vanes are disposed proximate a top and a bottom of the through hole.

4. The plenum of claim 3, wherein the first group of inlet guide vanes are disposed such that inlet guide vanes disposed proximate the top of the through hole are symmetric to inlet guide vanes disposed proximate the bottom of the through hole with-respect to a vertical axis of the plenum.

5. The plenum of claim 1, wherein the second group of inlet guide vanes are disposed proximate a first side of the through hole and the third group of inlet guide vanes are disposed proximate a second side of the through hole opposite the first side.

6. The plenum of claim 1, wherein at least one of the plurality of inlet guide vanes comprises a length that is different from another of the plurality of inlet guide vanes.

7. The plenum of claim 1, wherein the apparatus is a centrifugal compressor.

8. The plenum of claim 1, wherein each of the plurality of inlet guide vanes rotate an angle of about −30 to about 70 degrees with respect to a central axis of the plenum.

9. An apparatus for transferring energy between a rotating element and a fluid, comprising:

a housing having an inlet to allow a flow of fluid into the housing;

a plenum defining a flow path fluidly coupled to the inlet, the plenum having a through hole disposed through the plenum;

a plurality of inlet guide vanes disposed proximate a peripheral edge of the through hole, the plurality of inlet guide vanes comprising a first group of inlet guide vanes having a symmetrical profile, a second group of inlet guide vanes and a third group of inlet guide vanes, wherein the second group is separated from the third group by one or more inlet guide vanes of the first group; and wherein each inlet guide vane of the second group and third group have a cambered profile, and wherein each inlet guide vane of the third group has a different cambered profile from each other inlet guide vane of the third group;

further comprising a ring disposed at least partially within the through hole, wherein the plurality of inlet guide vanes are coupled to the ring;

wherein each of the plurality of inlet guide vanes are rotatably coupled to the ring, and wherein each of the plurality of inlet guide vanes rotate about an axis of rotation of each of the plurality of inlet guide vanes.

10. The apparatus of claim 9, wherein the plurality of inlet guide vanes are disposed symmetrically about the peripheral edge of the through hole.

11. The apparatus of claim 9, wherein the first group of inlet guide vanes are disposed proximate a top and a bottom of the through hole.

12. The apparatus of claim 9, wherein the second group of inlet guide vanes are disposed proximate a first side of the through hole and the third group of inlet guide vanes are disposed proximate a second side of the through hole opposite the first side.

13. The apparatus of claim 9, wherein at least one of the plurality of inlet guide vanes comprises a length that is different from another of the plurality of inlet guide vanes.

14. The apparatus of claim 9, wherein the apparatus is a centrifugal compressor.

15. The apparatus of claim 9, wherein each of the plurality of inlet guide vanes rotate an angle of about −30 to about 70 degrees with respect to a central axis of the plenum.

16. A plenum for use in an apparatus for transferring energy between a rotating element and a fluid, the plenum comprising:

a through hole disposed through the plenum;

a plurality of one piece inlet guide vanes disposed proximate a peripheral edge of the through hole, wherein the plurality of inlet guide vanes comprise:

a first group of inlet guide vanes having a symmetrical profile, a second group of inlet guide vanes and a third group of inlet guide vanes, wherein each inlet guide vane of the second group and third group has a cambered profile, and wherein each inlet guide vane of the third group has a different cambered profile from each other inlet guide vane of the third group;

further comprising a ring disposed at least partially within the through hole, wherein the plurality of inlet guide vanes are each rotatably coupled to the ring;

wherein each of the plurality of inlet guide vanes are rotatably coupled to the ring, and wherein each of the plurality of single body inlet guide vanes rotate about an axis of rotation of each of the plurality of inlet guide vanes.

17. The plenum of claim 16, wherein the plurality of inlet guide vanes are disposed symmetrically about the peripheral edge of the through hole.

18. The plenum of claim 16, wherein the first group of inlet guide vanes are disposed proximate a top and a bottom of the through hole.

19. The plenum of claim 18, wherein the first group of inlet guide vanes are disposed such that inlet guide vanes disposed proximate the top of the through hole are symmetric to inlet guide vanes disposed proximate the bottom of the through hole with-respect to a vertical axis of the plenum.

20. The plenum of claim 16, wherein the second group of inlet guide vanes are disposed proximate a first side of the through hole and the third group of inlet guide vanes are disposed proximate a second side of the through hole opposite the first side.

21. The plenum of claim 16, wherein at least one of the plurality of inlet guide vanes comprises a length that is different from another of the plurality of inlet guide vanes.

22. The plenum of claim 16, wherein the apparatus is a centrifugal compressor.

* * * * *